US005774905A

United States Patent [19]

Wager et al.

[11] Patent Number: 5,774,905

[45] Date of Patent: Jul. 7, 1998

[54] DEODORANT HOLDING DEVICE FOR A PLUMBING FIXTURE

[76] Inventors: Leonard E. Wager, 408 Fairview Dr., Whitby, Ontario, Canada, L1N 3A8; Dana S. Marshall, 63 Bennett Rd., West Hill, Ontario, Canada, M1E 3Y2

[21] Appl. No.: 914,087

[22] Filed: Aug. 19, 1997

[51] Int. Cl.[6] ..... E03D 9/02; E03D 13/00

[52] U.S. Cl. ..... 4/309; 4/222.1; 422/266; 422/277

[58] Field of Search ..... 4/309, 222, DIG. 5, 4/301, 300.3, 222.1; 422/266, 276, 277

[56] References Cited

U.S. PATENT DOCUMENTS

| | | | |
|---|---|---|---|
| 1,208,675 | 12/1916 | Sleight | 4/222.1 |
| 3,597,772 | 8/1971 | Leavitt et al. | 4/222.1 |
| 4,103,367 | 8/1978 | Kaufer | 4/309 |
| 4,574,403 | 3/1986 | Dintemann et al. | 4/309 |
| 5,313,672 | 5/1994 | Luedtke et al. | 4/309 |
| 5,489,415 | 2/1996 | Van Vlahakis et al. | 4/231 |

FOREIGN PATENT DOCUMENTS

| | | | |
|---|---|---|---|
| 1915249 | 3/1969 | Germany | 4/309 |

*Primary Examiner*—Charles R. Eloshway
*Attorney, Agent, or Firm*—Merek & Voorhees

[57] ABSTRACT

A deodorant holding device for a plumbing fixture. The device is comprised generally of a base, having an upper and a bottom surface, and a deodorant receiving cavity. The base has a plurality of upwardly extending pin members positioned on its upper surface. The pin members deflect and limit splashing of liquid directed onto the base. A cover is releasably securable to the bottom of the base in order to releasably retain deodorizing material within the cavity.

9 Claims, 3 Drawing Sheets

DEODORANT HOLDING DEVICE FOR A PLUMBING FIXTURE

FIELD OF THE INVENTION

This invention relates to a deodorant holding device of the type that may be used within a plumbing fixture. In particular the invention relates to such a deodorant holding device which may be used in a urinal and the like.

BACKGROUND OF THE INVENTION

Deodorant holding and deodorizing devices for plumbing fixtures have been used for a considerable length of time. Such devices typically fall within two separate categories; the first being wall mounted units that contain deodorizing liquid that is delivered under controlled flow to the plumbing fixture; and the second being devices that are designed to hold a solid deodorizing bar or stick and which are inserted directly into the fixture itself. The present invention relates specifically to the latter category of such devices.

While deodorizing and deodorant holding devices that are designed to be inserted directly into a plumbing fixture are commonly used, particularly in commercial or public washrooms, they suffer from a variety of limitations that restrict their application and usefulness. For example, many such devices are formed from a rigid material and are not readily adaptable to the different sizes and shapes of plumbing fixtures. Other devices fail to provide a means to easily or readily replace the deodorizing bar or stick within them and in many instances must be disposed of and replaced with a new device once the deodorant has been used up. Further, such prior devices typically present a smooth and hard surface which is prone to splashing, making them undesirable and less sanitary. Accordingly, there continues to exist a need for an improved deodorant holding device for use in plumbing fixtures that address the limitations of existing devices currently in use.

SUMMARY OF THE INVENTION

The invention therefore provides a deodorant holding device for a plumbing fixture that includes a base and a deodorant receiving cavity such that deodorant bars or sticks can be readily replaced as necessary. The invention also provides a device that is easily adaptable to the shape of the interior surface of a plumbing fixture and one that reduces or prevents splashing of liquid directed onto it.

Accordingly, in one of its aspects the invention provides a deodorant holding device for a plumbing fixture, the device comprising a base, having an upper and a bottom surface, and a deodorant receiving cavity, said base having positioned on its upper surface a plurality of upwardly extending pin members providing a means to deflect and to limit splashing of liquid directed onto said base.

In a further aspect the base includes wedge members on its bottom surface, said wedge members supporting said base when said base is positioned within a plumbing fixture and elevating said base from the plumbing fixture to present a fluid flow passageway between said base and the plumbing fixture.

Further objects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
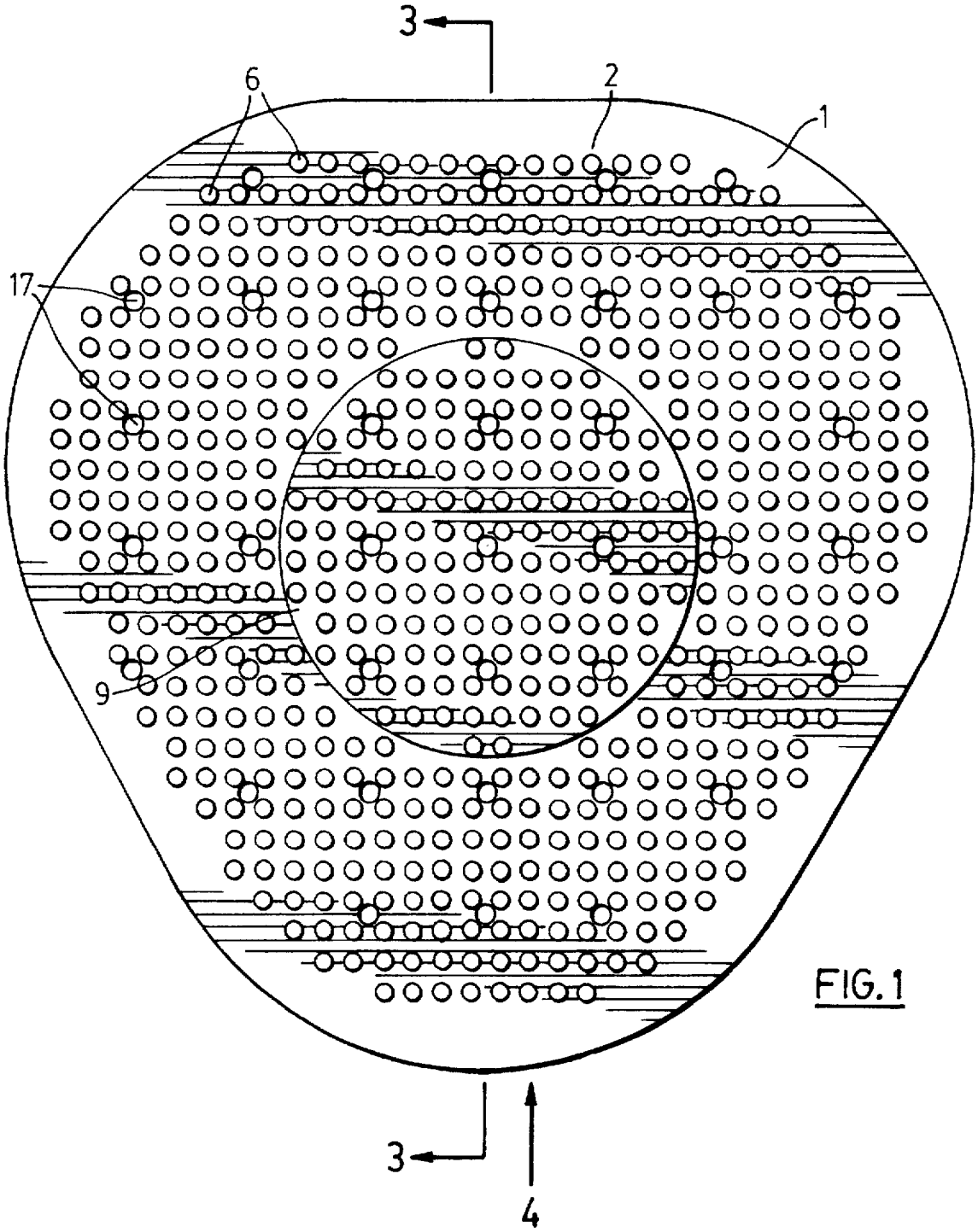
FIG. 1 is a top plan view of the device according to the present invention.

Referring to FIG. 1, the deodorant holding device according to the present invention is noted generally by the reference numeral 1. Device 1 is comprised primarily of a base 2, having an upper surface 3 and a bottom surface 4, and a deodorant receiving cavity 5. Base 2 is preferably a relatively thin planar member with its upper surface substantially covered by a series of closely spaced and upwardly extending pin members 6. Pin members 6 are preferably arranged in a grid across the upper surface of base 2 and provide a means to deflect liquid directed onto the upper surface of the base and to limit splashing.

Figure 2:
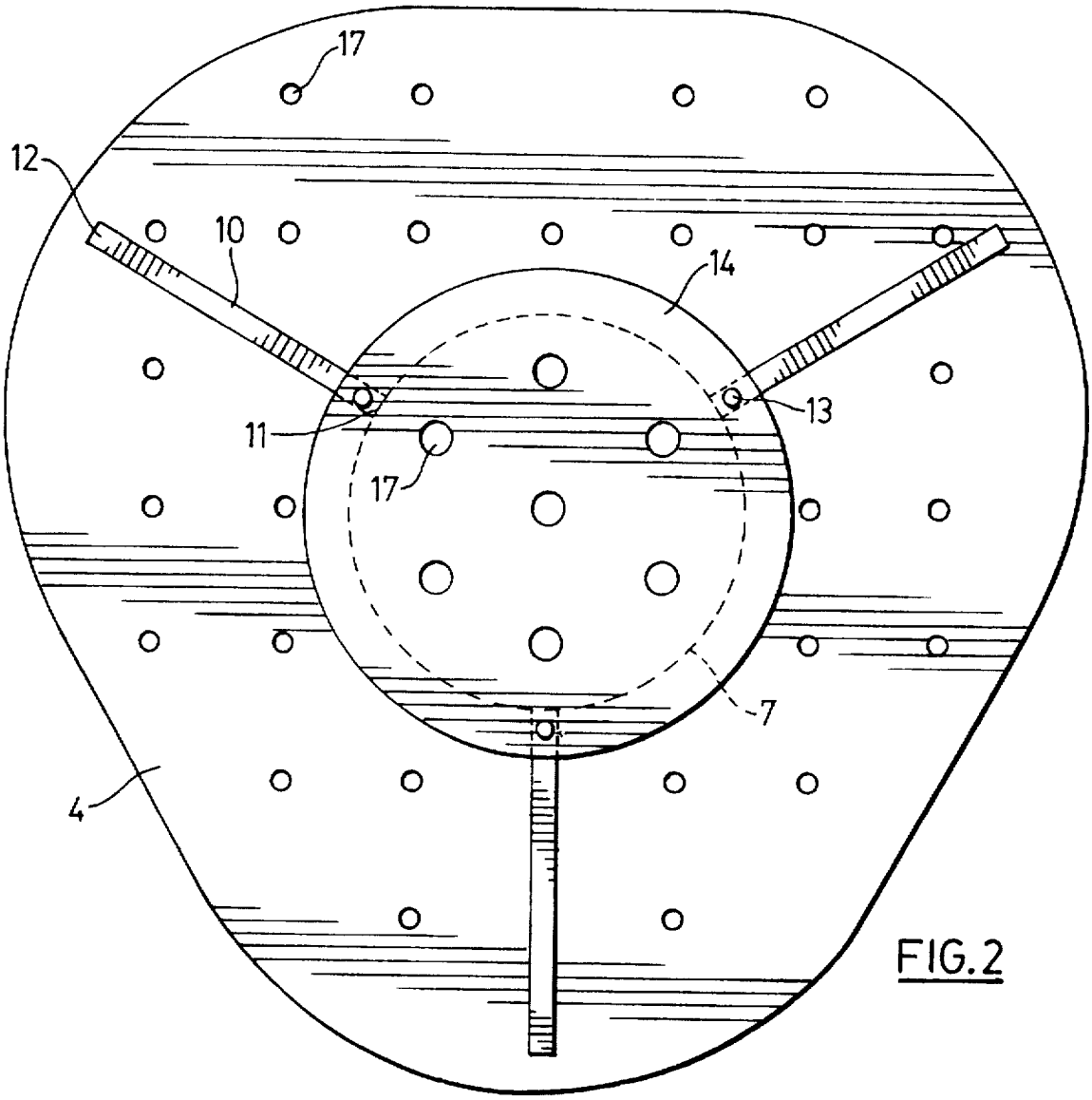
FIG. 2 is a bottom view of the device of FIG. 1.
Figure 3:
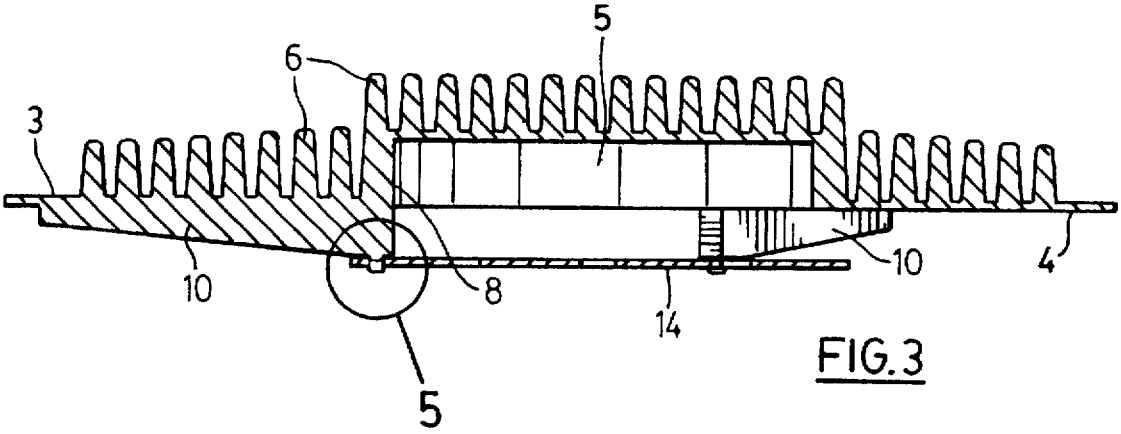
FIG. 3 is a sectional view taken along the line 3—3 of FIG. 1.

As is shown more clearly in FIGS. 2 and 3, the bottom surface 4 of base 2 has an opening 7 therethrough that allows access to deodorant receiving cavity 5. Cavity 5 extends upwardly from the top or upper surface 3 of the base and is defined by upwardly extending side surfaces 8 and a top 9. That is, deodorant receiving cavity 5 extends upwardly from base 2 and aligns with opening 7 which thus presents a means to allow for the insertion of deodorant or deodorizing material into cavity 5. It will be appreciated that a wide variety of commercially available deodorants and deodorizing materials may be used. Typically, solid deodorizing or deodorant bars or sticks which are sometimes referred to as "pucks" would be used.

As is the case for upper surface 3 of base 2, top 9 of cavity 5 is also covered with a plurality of pin members 6. While the pin members 6 positioned on top 9 extend radially upward to a greater degree than those positioned directly upon the upper surface of base 2, they nevertheless serve the same function and help to deflect and limit splashing of liquid directed onto cavity 5.

It will be understood that pin members 6 may take the form of a variety of different shapes while maintaining their desired function. It will also be understood that the length of the individual pins and the degree to which they extend radially upward from upper surface 3 and top 9 will largely dictate the spacing between adjacent pin members. That is, the larger and longer the pin members are, generally the greater that adjacent pins may be spaced apart while still performing the function of deflecting liquid and limiting splashing. Pins having a smaller cross-sectional area and a lesser height must generally be arranged in a more closely spaced and more densely packed grid. However, it will also be readily apparent to those skilled in the art that it will be important that there be a sufficient number of pin members across the upper surface of base 2 to limit the amount of exposed surface area of the base. In general the greater the expose surface area, the greater potential there exists for splashing.

Figure 4:
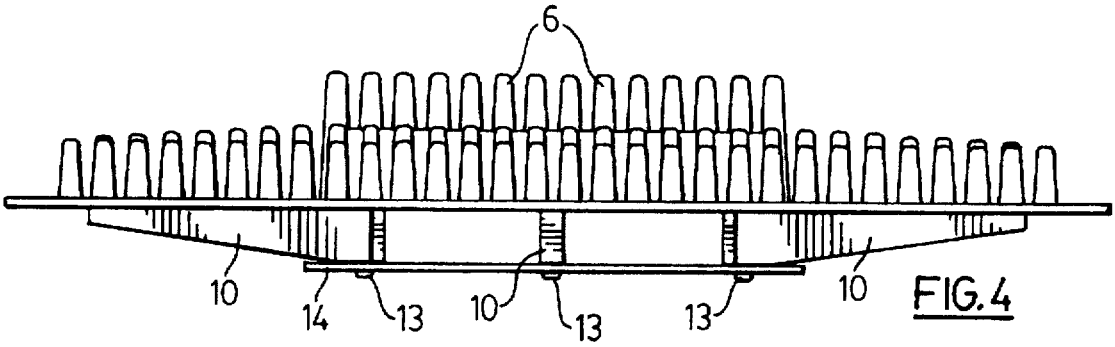
FIG. 4 is a side elevational view from direction "4" as indicated in FIG. 1; and, FIG. 5 is a detail view of the portion "5" of FIG. 3.
Figure 5:
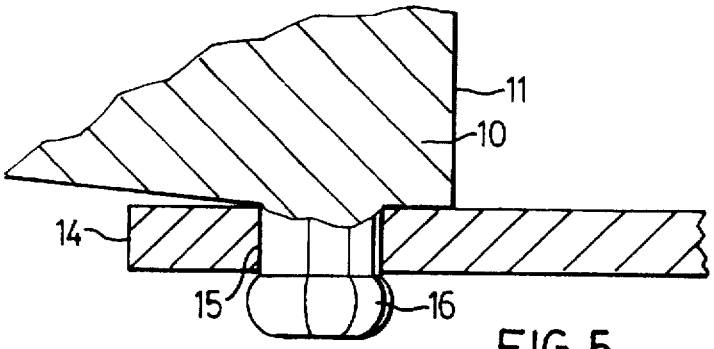

Furthermore, while a variety of different shapes of pins may be utilized the presence of smooth and rounded surfaces is preferred in order to help deflect and disperse liquid directed onto device 1. For this reason pin members 6 in the preferred embodiment are generally cylindrical with rounded top portions. In addition, and as shown in FIGS. 3 and 4, the pin members 6 that are positioned toward the interior or centre of base 2 are preferably slightly longer or higher than corresponding pin members situated toward the outer edge of the base. That is, the topography of the pin members rises slightly as one progresses from the edge of device 1 toward its centre. This feature has been found advantageous as it helps to ensure that the tops of pin members 6 will not lie in a single horizontal plane and thereby will not present an overall flat surface.

Referring now to FIGS. 2 through 4, base 2 also includes wedge members 10 on its bottom surface 4. Wedge members 10 support base 2, and hence device 1, when the base is placed within a plumbing fixture. Wedge members 10 generally comprise a series of relatively thin radially oriented arms on the lower surface of the base and preferably decrease in height toward the outer edge of the base, such that their inner most ends 11 are thicker or taller than their outer most ends 12.

In the embodiment of the present invention shown in the attached drawings base 2 is of a generally triangular shape having rounded corners. However, it will be appreciated by those skilled in the art that base 2 could also be formed in a wide variety of other shaped, depending upon the particular application for the device. In the case of a generally triangular shaped base, preferably 3 wedge members 10 are utilized and positioned such that they are approximately aligned with the corners of the triangular shaped base, and generally 60 degrees apart. This configuration of wedge members 10 will ensure base 2 is fully supported when placed within a plumbing fixture. It will be appreciated that other configurations of the base may necessitate different configurations for wedge members 10 in order to provide full support.

As shown in FIGS. 2 through 5, the inner most ends 11 of wedge members 10 preferably align generally with opening 7 in bottom surface 4. Ends 11 also include outwardly extending posts 13 that receive and releasably secure a cover 14 that may be used to enclose the lower portion of cavity 5. Cover 14 is preferably slightly larger in diameter than opening 7 such that posts 13 may be received within holes 15 near the edge of cover 14 and thereby releasably secure the cover over opening 7. Cover 14 is maintained in place through frictional contact between posts 13 and holes 15. In this manner cover 14 may be used to enclose deodorant receiving cavity 5 and thereby also releasably retain a deodorant bar or stick within the cavity. While posts 13 could take the form of a variety of different structural shapes, in the one embodiment they comprise generally cylindrical shaped members with slightly enlarged ends 16. In the embodiment shown in FIGS. 4 and 5, ends 16 have a diameter slightly larger than holes 15 such that cover 14 may essentially be "snapped" into place over posts 13 and retained thereon. It will be appreciated that other structural shapes for posts 13 and ends 16 could equally be utilized.

So as to provide a means for liquid to readily pass through device 1, and also to provide a means for deodorizing vapours to escape from cavity 5, in the preferred embodiment both deodorizing cavity 5 and base 2 include a plurality of openings or holes 17 through their upper surfaces. Similarly, cover 14 also contains a series of holes 17 through it. Generally holes 17 will lie in a grid pattern such that individual holes are spaced between pin members 6.

In use, cover 14 may be removed from its position as held upon posts 13 through lifting the cover from the posts and breaking the frictional bond therebetween. To assist in these regards device 1 is preferably comprised of a flexibly resilient material such as plastic or rubber. Once cover 14 has been removed a deodorizing material, such as a bar, stick or puck, can be inserted into cavity 5 through opening 7. Thereafter cover 14 may be replaced, with holes 15 received over posts 13, so that the cover is held securely in place. Device 1 may then be placed within a urinal or other plumbing fixture for use. The flexibility of the material from which device 1 is comprised will allow it to conform to the surface of the plumbing fixture. Holes 17 will provide a means for deodorizing vapours to escape cavity 5 and will also provide a means for fluid drainage though the device. Wedge members 10 both support the base on the surface of the plumbing fixture and also serve to elevate the base slightly, allowing for fluid to readily flow beneath it. Finally, pin members 6, positioned on both the upper surface 3 of base 2 and the top 9 of deodorant receiving cavity 5, will deflect fluid directed onto the base and limit splashing. When the deodorizing material within cavity 5 is consumed, cover 14 may be removed to allow for the addition of further deodorizing material.

It is to be understood that what has been described are the preferred embodiments of the invention and that it may be possible to make variations to these embodiments while staying within the broad scope of the invention. Some of these variations have been discussed while others will be readily apparent to those skilled in the art.

I claim:

1. A deodorant holding device for a plumbing fixture, the device comprising a base, having an upper and a bottom surface, and a deodorant receiving cavity, said base having positioned on its upper surface a plurality of upwardly extending pin members providing a means to deflect and to limit splashing of liquid directed onto said base;

said base includes wedge members on its bottom surface, said wedge members supporting said base when said base is positioned within a plumbing fixture and elevating said base from the plumbing fixture to present a fluid flow passageway between said base and the plumbing fixture;

a cover to enclose said opening in said bottom surface of said base, said cover releasably securable to said base to allow deodorizing material to be releasably retained within said cavity;

said wedge members contain outwardly extending posts, said posts being received within holes in said cover to allow said cover to be releaseably secured to said base.

2. A device as claimed in claim 1 wherein said deodorant receiving cavity extends upwardly from said upper surface of said base, said bottom surface of said base having an opening therein to allow access to said cavity and to allow for the insertion of a deodorizing material into said cavity.

3. A device as claimed in claim 2 wherein said deodorant receiving cavity includes a plurality of said pin members on its upper surface, said pin members on said upper surface of said cavity helping to deflect and to limit splashing of liquid directed onto said base.

4. A device as claimed in claim 3 wherein said deodorant receiving cavity and said base include drainage holes to allow liquid to pass therethrough.

5. A device as claimed in claim 4 wherein said pin members are generally cylindrical in shape with rounded upper ends so as to help deflect and disperse liquid directed onto said base.

6. A device as claimed in claim 5 wherein said pin members positioned near the centre of said upper surface of said base are longer and extend upwardly from said upper surface of said base to a greater degree than said pin members situated near the edge of said base.

7. A device as claimed in claim 6 wherein said cover is releasably secured to said wedge members and said posts through frictional contact therewith.

8. A device as claimed in claim 7 wherein said base is generally triangular in shape.

9. A device as claimed in claim 8 comprised of a flexibly resilient material.

* * * * *

UNITED STATES PATENT AND TRADEMARK OFFICE

CERTIFICATE OF CORRECTION

PATENT NO. : 5,774,905
DATED : July 7, 1998
INVENTOR(S) : Leonard E. Wagner and Dana S. Marshall It is certified that error appears in the above-identified patent and that said Letters Patent is hereby corrected as shown below:

Title page,
Inventors, the first named inventor's name should be spelled -- Wagner --.

Signed and Sealed this

Second Day of April, 2002

*Attest:*

*Attesting Officer*

JAMES E. ROGAN
*Director of the United States Patent and Trademark Office*